United States Patent [19]

Terrell

[11] Patent Number: 5,065,778

[45] Date of Patent: Nov. 19, 1991

[54] FINGER NAIL POLISH REMOVING DEVICE

[76] Inventor: Joye L. Terrell, 6516 Ridgeview Cir., Dallas, Tex. 75240

[21] Appl. No.: 544,985

[22] Filed: Jun. 28, 1990

[51] Int. Cl.[5] ..... A45D 29/18

[52] U.S. Cl. ..... 132/74.5; 132/73

[58] Field of Search ..... 132/73, 73.6, 74.5, 132/75, 75.8

[56] References Cited

U.S. PATENT DOCUMENTS

| | | | |
|---|---|---|---|
| 1,282,485 | 10/1918 | Sterling | 132/73 X |
| 1,524,681 | 10/1950 | Roosa | 132/75 |
| 2,424,509 | 7/1947 | Singer | 15/97 R |
| 2,629,124 | 2/1953 | Merritt | 132/73 |
| 3,060,942 | 10/1962 | Finlay | 132/73.5 |
| 3,316,922 | 5/1967 | Seidler | 132/75 |
| 3,369,266 | 2/1968 | Willson | 15/104.92 |
| 3,369,553 | 2/1968 | Keesee | 132/73.5 |
| 4,022,228 | 5/1977 | Ropp et al. | 132/75 |
| 4,282,891 | 8/1981 | Duceppe | 132/75 |
| 4,446,965 | 5/1984 | Montiel | 132/73 |
| 4,476,883 | 10/1984 | Diaz | 132/73 |
| 4,510,954 | 4/1985 | Miller | 132/75 |
| 4,800,606 | 1/1989 | Kolesky | 132/73.6 |

FOREIGN PATENT DOCUMENTS

| | | | |
|---|---|---|---|
| 0193496 | 9/1986 | European Pat. Off. | 132/73 |
| WO8204179 | 12/1982 | PCT Int'l Appl. | 132/73 |

*Primary Examiner*—John J. Wilson
*Assistant Examiner*—Frank A. LaViola
*Attorney, Agent, or Firm*—Warren H. Kintzinger

[57] ABSTRACT

A finger nail polish removing structure including a container for holding nail polish removing liquid with a base and a lid, and a finger nail scrubbing structure mounted within the container in spaced relation to the container base bottom wall and to the lid top wall, defining a liquid chamber in the base and an upper chamber above the finger nail scrubbing structure. In some embodiments the finger nail scrubbing structure is supported within the container base, and includes five finger bore openings with four bore openings, of substantially equal diameter on a circle within the planar extent of the finger nail scrubbing structure and with the fifth bore opening a thumb tip receiving opening of greater diameter than the other four finger openings and displaced closer to the center of the finger nail scrubbing structure to receive simultaneously the finger nails and nail finger tips to the nail end joints of all five fingers of one hand. The finger bore openings present sponge-like scrubbing material inner walls to remove nail polish from the nails, and the nail polish removing liquid is sloshed between the bottom and the upper chambers to saturate the finger bore opening wall surfaces with cleaning liquid and after use to clean the walls.

12 Claims, 2 Drawing Sheets

FINGER NAIL POLISH REMOVING DEVICE

Figure 1:
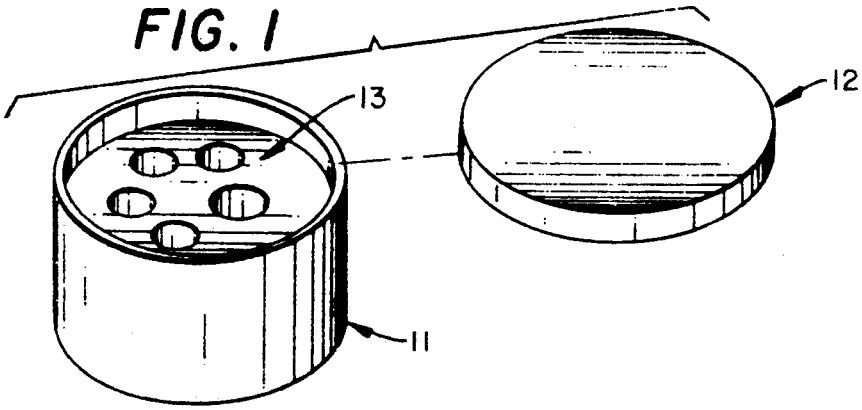

This invention relates to the removal of finger nail polish when desired, and more particularly, to a finger nail polish removing device for removing nail polish simultaneously from all the fingers of one hand.

There have been many finger nail polish removing methods and devices, some messy, time consuming, cumbersome and impractical to use, particularly in the home. Some nail polish removing devices include bristle type scrubbing elements that inherently have a number of disadvantages. With bristles stiff enough to provide effective scrubbing they are likely to irritate tender tissue around fingernails. Conversely if the bristles are too soft they may not provide an effective scrubbing action. With nail polish removing devices using resilient bristles splattering of the cleaning liquid is a hazard to the user's eyes and clothing with the process being messy at best.

It is therefore a principal object of this invention to provide a finger nail polish removing device capable of quickly and easily removing nail polish simultaneously from all five fingers of either hand.

Another object is to provide such removal of polish through a brief, gentle and effective scrubbing action.

A further object is to provide such a finger nail polish removing device clean in design and of simple construction, economical and excellent for use at home and by the professional manicurist.

Features of the invention useful in accomplishing the above objectives include, in a finger nail polish removing device, a finger nail polish structure including a container for holding nail polish removing liquid with a base and a lid, and a finger nail scrubbing structure in the form of a transverse bridging member mounted within the container in spaced relation to the container base bottom wall and to the lid top wall, defining a liquid chamber in the base and an upper chamber above the finger nail scrubbing structure. In some embodiments the finger nail scrubbing structure as a transverse bridging member is supported within the container base, and includes five finger bore openings with four bore openings, of substantially equal diameter on a circle within the planar extent of the finger nail scrubbing structure and with the fifth bore opening a thumb tip receiving opening of greater diameter than the other four finger openings and displaced closer to the center of the finger nail scrubbing structure to receive simultaneously the finger nails and nail finger tips to the nail end joints of all five fingers of one hand. The finger bore openings present sponge-like scrubbing material innder walls to remove nail polish from the nails, and the polish removing liquid is sloshed between the bottom and the upper chambers to saturate the finger bore opening walls surfaces with cleaning liquid and after use to clean the walls. In one embodiment finger bore opening liners of sponge-like scrubbing material are are provided that are removable and replaceable scrubbing pads.

Specific embodiments representing what are presently regarded as the best modes of carrying out the invention are illustrated in the accompanying drawings.

Figure 2:
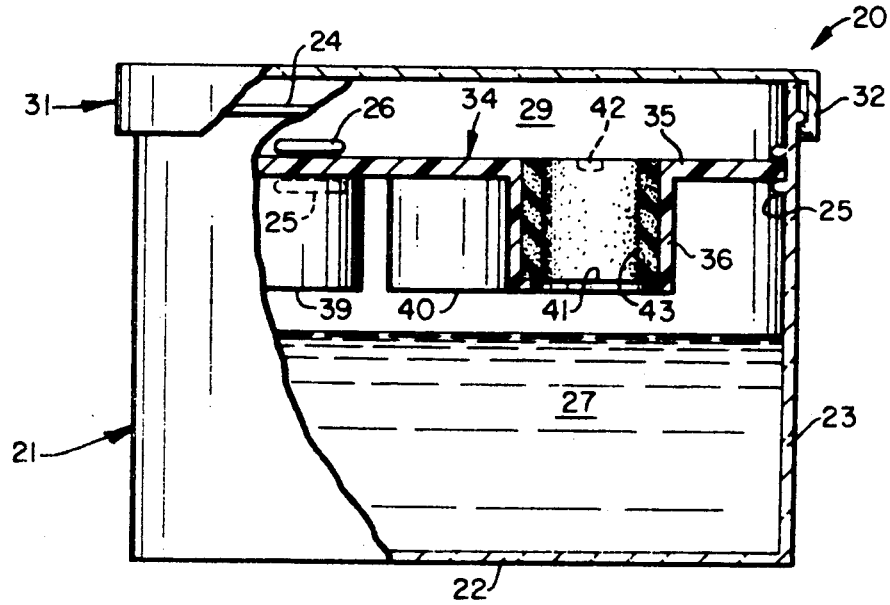
Figure 3:
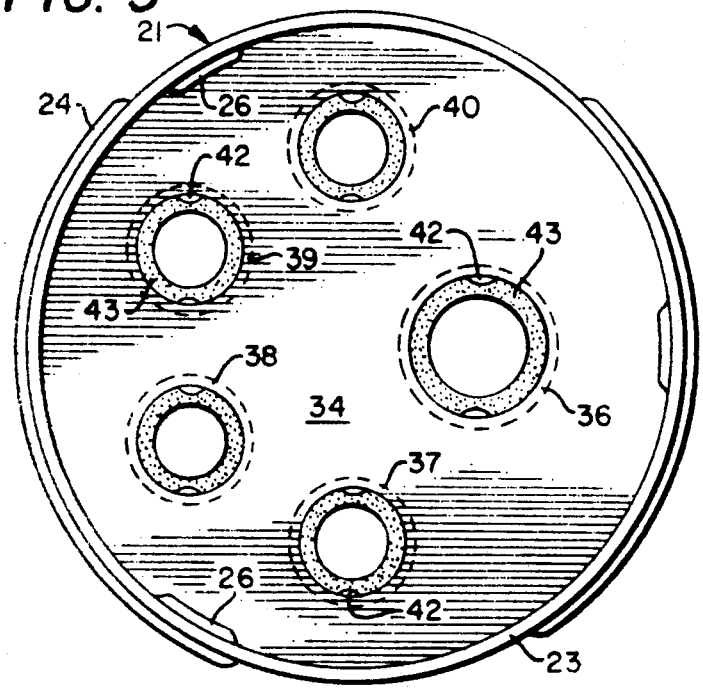
Figure 4:
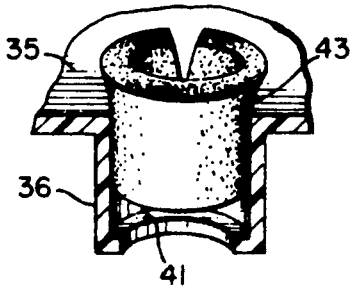
Figure 5:
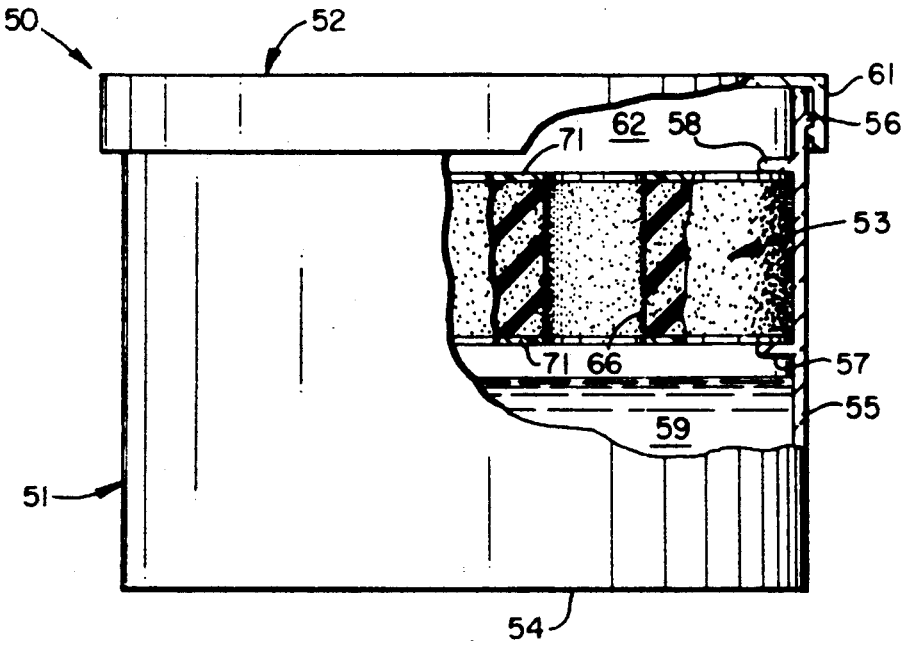
Figure 7:
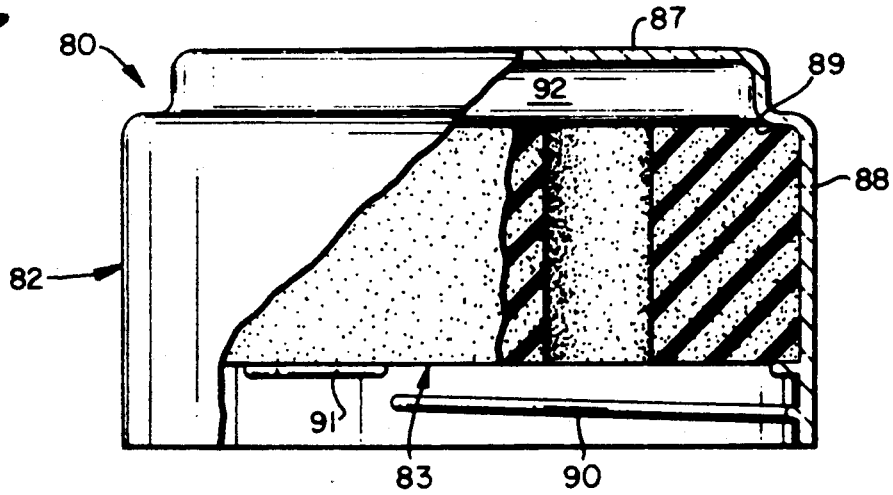
Figure 6:
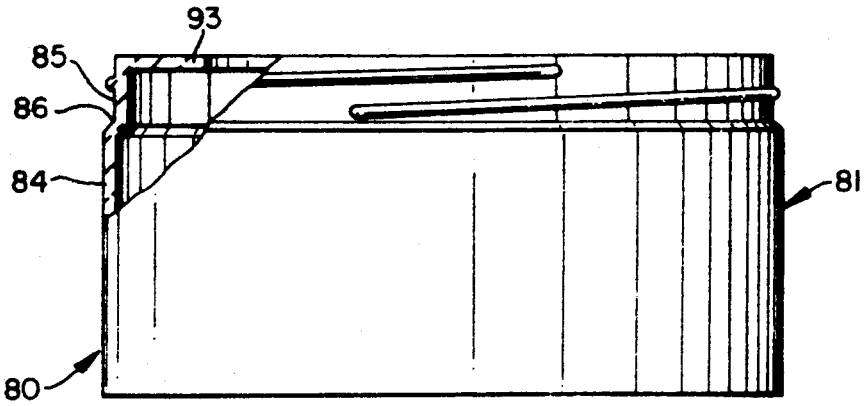

In the drawings:

FIG. 1 represents a perspective view of the finger nail polish removing structure with the scrubber member mounted in a container with the lid removed to the side;

FIG. 2, a partially cut away and sectioned side elevation view of the finger nail polish removing structure of Claim 1;

FIG. 3, a top plan view of the container base with the scrubber member mounted therein and the lid removed from view;

FIG. 4, a partial cut away and sectioned view of a thumb finger bore opening such as used in the embodiment of FIGS. 2 and 3, with a scrubbing pad liner partially removed;

FIG. 5, a partially cut away and sectioned side elevation view of another embodiment of the finger nail polish removing structure shown generally in FIG. 1;

FIG. 6, a partially cut away and sectioned side elevation view of the polish remover fluid containing reservoir base in still another embodiment using the lid of FIG. 7; and, FIG. 7, a partially cut away and sectioned side elevation view of the lid with internal detail of a finger nail polish removing device.

Referring to the drawings:

The general form of the invention is shown in FIG. 1 to include a container base 11, the removed container lid 12 and a scrubbing member 13 supported within the container base 11.

Referring now to a preferred embodiment 20 of a finger nail polish removing structure, from the general showing of FIG. 1, as shown in detail in FIGS. 2, 3 and 4, the container base 21 is cup-shaped having a bottom wall 22 and an annular cylindrical side wall 23. External thread segments 24 are provided adjacent the open upper end of container base 21 including lower support ribs 25 and upper support ribs 26 that may be either continuous or discontinuous annular ribs positioned to support scrubbing member 34 adjacent to the open top of the container base 11. Thus, there is thereby defined an unobstructured liquid chamber 27 in the lower portion of the base 21 between the scrubbing member 34 and bottom wall 22. The container base 21 is fabricated of a suitable material such as glass or preferably, a plastic material moldable by a suitable molding or vacuum forming technique. It is desired that the base be either transparent or semi-transparent for content observation of the polish removal fluid level and the condition of the fluid after periods of use.

Lid 31 is generally flat and shallow having a short depending cylindrical flange 32 with internal threads engageable with container base threads 24. The lid 31 is constructed to seat on the top lip of the container base 21 to provide a liquid and airtight closing seal when tightened thereon.

Scrubbing member 34 is disk-like having a planar transverse wall 35 and integrally formed finger bore opening cylindrical walls 36, 37, 38, 39 and 40. The scrubbing member 34 is made, for example, of a rigid plastic material with the planar transverse wall 35 being circular and supported at its peripheral edge between lower and upper support ribs 25 and 26 of the container base 21. These cooperating parts are designed and constructed relative to each other such that the scrubber member can be snapped into place for assembly and snapped out of place when the scrubber member 34 is removed for cleaning thereof. The disk-like scrubber member 34 defines a partition that substantially closes the lower liquid chamber 27 except for the through passages provided by the finger bore openings. As shown in the assembled state in FIG. 2 an upper chamber 29 is defined between the upper face of the scrubber member 34 and the lid 31 with substantially the only communication between the chambers 26 and 29 being the finger bore openings.

The finger bore openings 36–40 are generally of the same configuration with the finger bore opening 36 for the thumb of a hand being larger than the four finger bore openings 37–40, that are disposed on a circle about the center of scrubber member 34, and with the thumb bore opening 36 disposed closer to the center. These finger bore openings 36–40 are so arranged in the scrubber member 34 to receive simultaneously the thumb and fingers of either hand of a user. Referring again to FIG. 2 the finger bore opening wall 36 has a lower internal support lip 41 and upper support ribs 42 for locating and retaining a scrubbing sponge-like material liner 43 as a cylindrical wall liner. Wall liner 43, in addition to lip 41 and upper ribs 42, may be cemented to the finger bore opening wall(s). The opening wall liner 43 consists of a substantially rectangular piece of sponge-like sheet material, such as sponge rubber, that is inserted within the finger bore opening wall 36, in accord with the showing of FIG. 4, to be retained therein by its own resilience and by the support of lip 41, ribs 42 and any cement that may be used.

Dimensions of interest in the finger nail polish removing structure 20 is an overall diameter of about four inches for the scrubbing member 34, finger bore openings 37–40 having a one half inch inner diameter positioned on a circle of about two and one half inch diameter, the finger bore opening 36 for a thumb being about three fourths inch inner diameter and disposed inwardly from the circle of the other four finger bore openings.

With the structure 20 holding a supply of nail polish remover liquid in chamber 27 of the container base 21 the closed sealed device is inverted to permit the liquid to pass through the finger bore openings to saturate the sponge-like inner walls of the liners 43 with the polish removing liquid. The device 20 is then placed in the upright position and the cap 31 removed. The finger nails and finger tips to the finger tip joints are then inserted into the finger bore openings and moved up and down several times to effectively remove all the polish from the nails. Following this stage of usage the lid 31 is again seal tightened on the base and the container inverted to effect a flushing of the finger bore opening surfaces by the liquid passed therethrough between the chambers 29 and 27. Sediment that collects over a period of time settles to the bottom of the base chamber 27 where it can be observed through the transparent base walls to tell when the polish remover liquid should be replaced and the device cleaned.

Referring to the additional finger nail polish removing structure 50 embodiment of FIG. 5 there are many similarities to the device 20 of FIGS. 2–4 with the main difference being in the configuration of scrubbing member 53. This finger nail polish removing structure 50 includes a transparent material container base 51, a container lid 52 and scrubbing member 53 that is a disk element of sponge-like material, such as sponge rubber of substantial thickness in the range of approximately one to one and one half inches. The scrubbing member 53 has a cylindrical exterior wall sized for a snug fit with the inner cylindrical wall of the container base 51.

This sponge rubber scrubbing member 53 must be sufficiently firm to support itself within the base between the support ribs 57 and 58; and the construction is such that the pores of the sponge rubber are relatively small along with minimum internal communication between the pores of the sponge rubber, to provide for minimum absorption of liquid within the body of the element. The scrubbing member 53 is provided with five finger bore openings 66 having the same arrangement, when viewed from the top, as the bore openings of the scrubbing member 34. Since it is desirable that only the surfaces of the finger bore openings be staurated with the cleaning liquid, the scrubbing member may be provided with upper and lower moisture impervious surface skins 71 which have holes aligned with the finger bore openings and which otherwise prevent contact of the liquid with the sponge rubber scrubbing member.

By way of example of dimensions of the device 50, the scrubbing member may have an overall diameter of about four inches and a thickness of one or more inches with the finger bore openings having the same inner diameters and being arranged in the same manner as the finger bore openings for the device 20; and the finger bore openings may be cleansed in the same manner.

Referring to still another embodiment, shown in FIGS. 6 and 7, the device 80 consists of a container base 81, a lid 82 and a scrubbing member 83 supported within the lid 82. Container base 81 is similar to the bases previously described, except that it is shallower; the cylindrical wall 84 is provided with a reduced diameter neck portion 85 carrying external threading, and the cylindrical wall and neck portion define a sealing shoulder 86.

The lid 82 is a cup-shaped member having a flat top wall 87 and generally cylindrical side wall 88 but has a reduced diameter top portion defining a support shoulder 89. The lid is provided, at its open lip, with internal threads 90 for engagement with the base threads, with the lip of the lid providing sealing engagement with the shoulder 86. Lower support ribs 91 are provided for supporting the scrubbing element in spaced relation to the lip of the lid.

The scrubbing element 83 may be identical to the scrubbing member 53 of the device 50, but is shown as comprising simply a disk-like sponge rubber element supported in the lid 82 between the shoulder 89 and the support ribs 91. This element is provided with the five finger bores 96 in the same manner as the element 53. In assembled relation a top chamber 92 is provided between the lid top wall 87 and the scrubbing member 83; and the liquid chamber is defined by the container base itself.

It may be desirable that the container base be provided with an anti-spillage lip 93, at the top, to minimize any spilling when the lid is removed from the base. This is particularly desirable in this configuration where the base has a large mouth opening. The inner diameter of the anti-spillage lip 93 should be such that the lip does not overlap the finger bores of the scrubbing member in assembled relation. This anti-spillage lip might be formed integral with the container base, or may be an insert member.

The device 80 is used in a manner similar to the previously described devices in that the device, before removing the lid, is inverted to saturate the finger bores with liquid. The liquid is then removed, after allowing time for draining the top chamber 92; and the lid is placed inverted on the support surface and the fingers of one hand inserted into the finger bores to remove the nail polish in the manner described. After use the cap and base are reassembled and the assembly again inverted to slosh liquid between the top chamber 92 and the liquid chamber to remove sediment from the walls of the finger bores.

For all forms of the previously described devices, the base is preferable transparent or near transparent for the reasons described. For all forms the seal between the lid and the base must be liquid tight, and should also be airtight to prevent evaporation of the contained lquid. In normal use, the component, either base or lid that contains the finger scrubbing member would be held against the supporting surface by one hand of the user while the nail polish is being removed from the user's other hand. It may be desirable that such component be provided with a suction cup for example, to retain such component on a support surface; or, alternatively, such component on a metal support surface.

What has been described are several forms of a device particularly adapted for the rapid and effective removal of finger nail polish from the finger nails of the user. All forms are quite simple in construction, to enable manufacture economically and insure availability to individual users in the home. The device is also adapted for use by professional manicurists, particularly in the form illustrated in FIGS. 2 through 4 which provides for replaceable finger bore liners. This may be desirable, or even required, in commercial establishments for sanitary reasons.

A particular advantage of the use of the device is that scrubbing of the fingernails is effective in that the fingers need to be in contact with the scrubbing members for only a few strokes, thereby minimizing the possibility of irritation of the tissues of the fingers from the polish removing solution.

Whereas this invention has been described with respect to several embodiments thereof, it should be realized that various changes may be made without departure from the essential contributions to the art made by the teachings hereof.

I claim:

1. A finger nail polish removing structural device comprising: a cylindrical container for nail polish removing liquid having a base portion with a bottom wall and a screw on lid with a top wall joinable together when screwed together with a liquid tight sealing joint; a finger nail scrubbing structure mounted by circumference mounting means of said cylindrical container to extend transversely across the interior of said container in spaced relation to said bottom wall defining a chamber for containing nail polish remover liquid in said base portion; said finger nail scrubbing structure being a transverse bridging member generally coextensive with the interior of said cylindrical container, provided with five finger nail and finger tip receiving bore openings generally parallel to each other and generally perpendicular to said bottom wall; four of said bore openings of a substantially equal diameter being positioned on a circle within the planar extent of said transverse bridging member and with the fifth bore opening being a thumb end receiving opening with a larger diameter than said four substantially equal diameter bore openings and displaced closer to the center of said transverse bridging member than the circle through the four bore openings to receive simultaneously the finger nails and nail finger tips to the nail joints of all five fingers of one hand; each of said finger bores having walls of sponge-like scrubbing material; said finger bore openings being dimensioned, bore size diameter and length, to receive the finger nails and finger tips to the nail joints of one hand in scrubbing relation for simultaneous scrubbing of the five finger nails of a hand; wherein said scrubbing structure forms a partition in space between said bottom wall and the top wall of said lid, with a top chamber between said scrubbing structure as a partition and said top wall; and said finger bore openings form fluid communication channels between said liquid chamber and said top chamber; said scrubbing structure includes a rigid member with cylindrical walled openings for said finger bore openings; and a cylindrical sponge-like material liner mounted in each of said cylindrical walled openings; and wherein said cylindrical sponge-like material liners are each a removable pad of a substantially rectangular piece of sheet sponge-like material.

2. The finger nail polish removal structural device of claim 1, wherein said scrubbing structure is a disk element of sponge-like material with said finger bore formed in and extending through said disk element; and with said disk thickness sufficient to accomodate finger nails and finger tips to nail joints of the five fingers of one hand, at a time of the user in a nail scrubbing relation.

3. The finger nail polish removal structural device of claim 2, wherein said disk element is provided with moisture proof film face layers on the upper and lower faces thereof; said upper and lower face film face layers having openings sized to and aligned with said finger bore openings; and with said upper and lower film face layers position adapted to retard moisture absorbtion to said sponge-like disk element except to and through the cylindrical walls of said finger bore openings.

4. The finger nail polish removal structural device of claim 1, wherein said finger bore opening liners are mounted by said circumference mounting means in said base adjacent to the top of said base.

5. The finger nail polish removal structural device of claim 4, wherein said finger nail scrubbing structure includes a rigid partition member having cylindrical walls for said finger bore openings; and with each of said finger bore openings including a wall liner of said sponge-like scrubbing material.

6. The finger nail polish removal structural device of claim 5, wherein said finger bore opening liners are removable; and said finger bore opening cylinder walls include retaining means for retaining said liners from axial movement relative to said finger bore opening cylinder walls.

7. The finger nail polish removal structural device of claim 6, wherein said rigid partition member is separate from said base; and the cylindrical wall of said base having support means holding said rigid partition member in spaced relation to said base bottom wall.

8. The finger nail polish removal structural device of claim 4, wherein said finger nail scrubbing structure is a disk-like element of sponge-like material; said finger bore openings being formed in said finger nail scrubbing structure; and with the overall thickness of said finger nail scrubbing structure being enough to accomodate the finger nails and nail finger tips to the nail joints simultaneously of all fingers of one hand.

9. The finger nail polish removal structural device of claim 1, wherein said finger nail scrubbing structure is supported in said lid.

10. The finger nail polish removal structural device of claim 9, wherein said finger nail scrubbing structure is a disk-like element of sponge-like material; said finger bore openings being formed in said finger nail scrubbing structure; and with the overall thickness of said finger nail scrubbing structure being enough to accomodate the finger nails and nail finger tips to the nail joints simultaneously of all five fingers of one hand.

11. The finger nail polish removal structural device of claim 1, wherein said base is sufficiently transparent to enable visual observation of the liquid and liquid level therein.

12. The finger nail polish removal structural device of claim 1, wherein said container and said finger nail scrubbing structure have support means for supporing said finger nail scrubbing structure in a manner for easy removal from said container and reinsertion therein.

* * * * *